US005085879A

United States Patent [19]

Elbaz

[11] Patent Number: 5,085,879

[45] Date of Patent: Feb. 4, 1992

[54] LOBSTER PACKAGING AND DISPLAY UNIT

[76] Inventor: Gabriel Elbaz, 4200 W. Sherbrooke, Suite 12, Montreal, Canada, H3C 1Z4

[21] Appl. No.: 734,743

[22] Filed: Jul. 23, 1991

Related U.S. Application Data

[63] Continuation-in-part of Ser. No. 600,749, Oct. 22, 1990, abandoned.

[51] Int. Cl.[5] ..... B65D 85/00; B65D 1/34

[52] U.S. Cl. ..... 426/129; 426/393; 426/396; 206/557; 206/564; 206/587; 206/822; 119/2

[58] Field of Search ..... 426/129, 393, 643, 396; 119/2; 206/564, 587, 822, 557

[56] References Cited

U.S. PATENT DOCUMENTS

| | | | |
|---|---|---|---|
| 161,596 | 4/1875 | Davis | 426/393 |
| 1,016,627 | 2/1912 | Higgins | 119/2 |
| 1,540,887 | 6/1925 | Hunley | 119/2 |
| 1,639,555 | 8/1927 | Clark | 119/2 |
| 1,906,375 | 5/1933 | Grande | 426/129 |
| 1,987,491 | 1/1935 | Nejelski | 426/129 |
| 2,266,664 | 12/1941 | Stevens | 119/2 |
| 2,316,607 | 4/1943 | MacDonald | 119/2 |
| 2,480,082 | 8/1949 | Lowry et al. | 426/393 |
| 3,099,567 | 7/1963 | Wallace et al. | 426/129 |
| 3,508,930 | 4/1970 | Bennett et al. | 426/129 |
| 3,556,337 | 1/1971 | Harmon et al. | 426/129 |
| 3,559,865 | 2/1971 | Field | 206/564 |
| 3,685,717 | 8/1972 | Seiferth et al. | 426/129 |
| 3,695,900 | 10/1972 | Young | 426/129 |
| 3,835,994 | 9/1974 | Davis et al. | 206/564 |
| 3,866,817 | 2/1975 | Holden | 206/564 |
| 4,173,655 | 11/1979 | Capo | 426/129 |
| 4,230,729 | 10/1980 | Hoelzel | 426/129 |
| 4,691,820 | 9/1987 | Martinez | 206/5.1 |
| 4,728,521 | 3/1988 | Mitchell | 426/129 |
| 4,798,728 | 1/1989 | Sugisawa et al. | 426/129 |
| 4,812,320 | 3/1989 | Ruzek | 426/129 |
| 4,840,271 | 6/1989 | Garwood | 426/129 |
| 4,840,276 | 6/1989 | George | 206/564 |
| 4,898,743 | 2/1990 | Ross et al. | 426/113 |
| 4,899,884 | 2/1990 | Madsen | 206/587 |
| 5,005,703 | 4/1991 | Bodker | 206/563 |

FOREIGN PATENT DOCUMENTS

| | | | |
|---|---|---|---|
| 770462 | 10/1967 | Canada | 426/393 |
| 1203349 | 8/1970 | United Kingdom | 206/564 |
| 2052443 | 1/1981 | United Kingdom | 426/129 |

OTHER PUBLICATIONS

Quick Frozen Foods 1/51 p. 82 plus.
Food Engineering 6/51 p. 163.

*Primary Examiner*—Steven Weinstein
*Attorney, Agent, or Firm*—Robic

[57] ABSTRACT

A lobster packaging and display unit that is preferably made of molded plastic material and free of any sharp edge or corner and comprises at least one and preferably two trays, each shaped and sized to receive and conform to a lobster and to display this lobster to best advantage.

21 Claims, 5 Drawing Sheets

FIG. 3
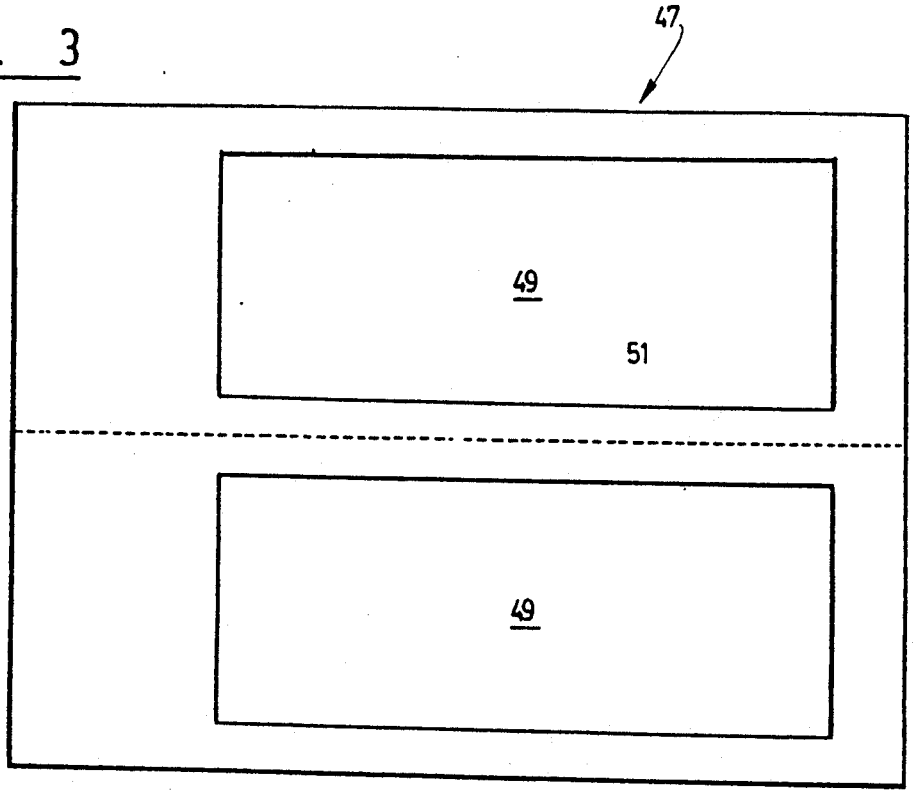
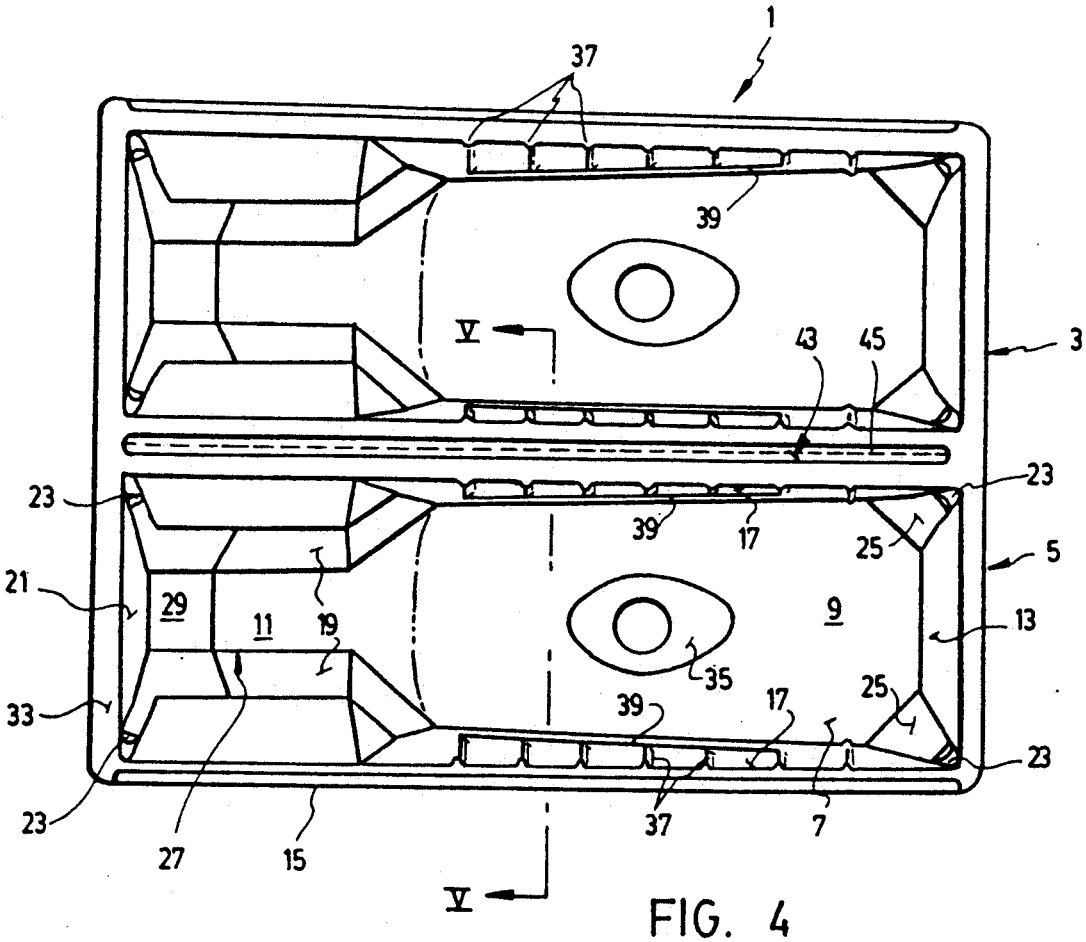
FIG. 4

LOBSTER PACKAGING AND DISPLAY UNIT

CROSS REFERENCE

This application is a continuation-in-part of application Ser. No. 07/600,749 filed on Oct. 22, 1990, now abandoned.

BACKGROUND OF THE INVENTION

1. Field of the Invention

The present invention relates to a lobster packaging and display unit comprising at least one and preferably two or more trays each shaped and sized to receive and conform to a fresh or frozen, raw or uncooked, half-cooked or fully cooked lobster, and to display it to best advantage.

2. Description of Related Art

A conventional method for packaging lobsters consists in freezing them with water to have them embedded in a block of ice and inserting this block into a plastic bag.

Another conventional method consists in freezing the lobsters, wrapping each of them in a wax paper and placing them in a box.

Whatever be their packaging, it is known that frozen lobsters are brittle and may have some of their parts, especially their claws, easily broken. However, it is also known that once the claws are broken, the commercial value of the lobsters is considerably diminished. Moreover, when frozen lobsters are packed in bulk, all of them must be defrosted at once.

SUMMARY OF THE INVENTION

The object of the present invention is to provide a new lobster packaging and display unit which overcomes the above mentioned problems associated with the prior art.

More particularly, the object of the invention is to provide a lobster packaging and display unit which is very simple yet efficient in structure especially to protect the lobster(s) against risks of breaking, which is easy to manufacture at low cost and easy to use, and which advantageously displays the lobster(s) to best advantage.

In accordance with the invention, this object achieved with a lobster packaging and display unit preferably made of a molded plastic material and comprising at least one and preferably two trays each shaped and sized to receive and conform to a lobster and to display this lobster to best advantage, wherein:

(a) each tray comprises:

a bottom wall having a front bottom wall portion and a rear bottom wall portion;

a front end wall;

a pair of side walls each having a front side wall portion and a rear side wall portion; and a rear end wall;

(b) the rear bottom wall portion, the rear side wall portions and the rear end wall are configured and oriented relative to each other so as to form a niche that is sufficiently narrow and deep to snugly receive and retain the tail of the lobster with this tail in folded position;

(c) the front bottom wall portion, the front side wall portions and the front end wall are configured and oriented relative to each other so as to form a space wide enough to receive the head and claws of the lobster with the claws extending fully forward on the space without substantially overlapping each other; and (d) the side walls, front end wall and rear end walls have upper edges that extend perpendicularly to each other in a same plane to define a continuous rectangular opening on top of each tray, this opening being at least as long as the bottom wall and at least as wide as the space.

The front end wall of each tray preferably has a height shorter than the height of the rear end wall so that the plane in which extend the upper edges defining the rectangular opening, is inclined downwardly towards the front end wall relative to the bottom wall.

Preferably also, the front bottom wall portion comprises a short upwardly projecting boss positioned centrally just in front of the head of the lobster between the claws the front bottom wall portion being generally flat and the rear bottom wall portion being angled upwardly rearwardly relative to the front bottom wall portion to raise the tail of the lobster with respect to its claws.

In accordance with a particularly preferred embodiment of the invention, each tray is free of any sharp corner or edge; the front end wall, the side walls, the rear end wall and the boss have smooth surface; and the upper edges also have smooth surfaces and define a rectangular flange extending in the plane. Thus, it becomes possible to heat seal each tray with a protective plastic film without having this plastic film being torn out by the lobster contained in said at least one tray.

Each of the front side wall portions preferably comprises at least one locking rib projecting inside each tray close to, and parallel to the front bottom wall portion. When the unit contains a lobster, freezing of a small layer of water poured inside each tray makes it possible to fix the lobster to the locking ribs inside the tray via the ice that is being formed.

BRIEF DESCRIPTION OF THE DRAWINGS

A more detailed but not restrictive description of the invention will now be given with reference to the appended drawings in which:

FIG. 3 is a top plan view of a box similar to the one shown in perspective in FIG. 8, provided with windows to give visual access to the lobsters contained in the unit;

FIG. 4 is a top plan view of the packaging display unit as shown in FIG. 1 without any lobster being shown;

DESCRIPTION OF SEVERAL PREFERRED EMBODIMENTS

Figure 1:
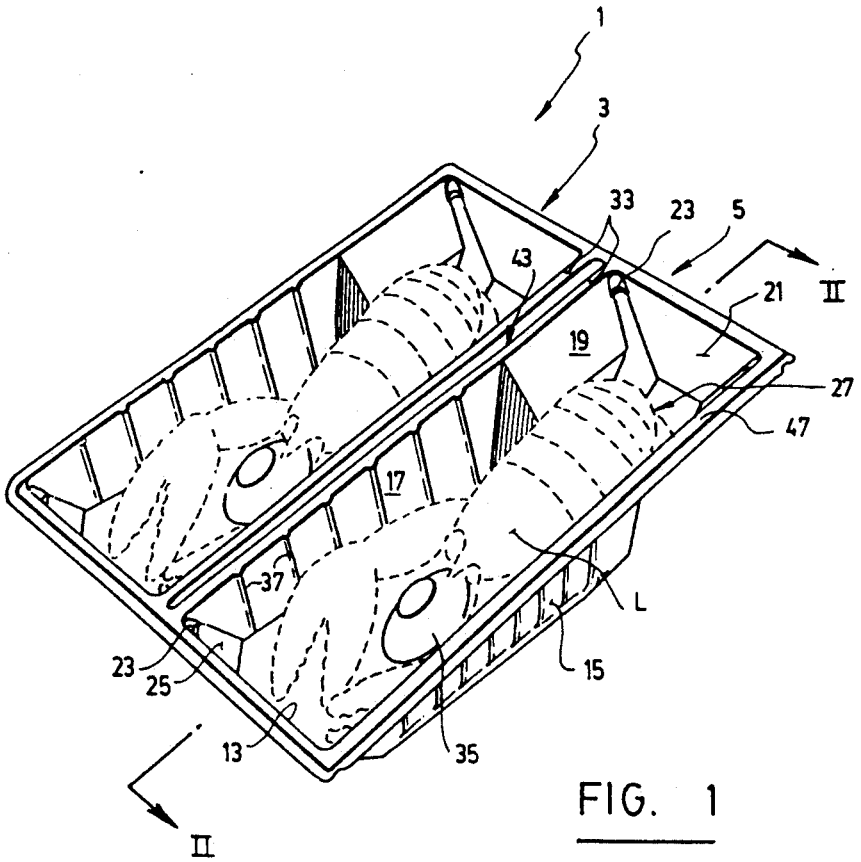
FIG. 1 is a perspective view of a lobster packaging and display unit according to the invention, comprising two separable trays.
Figure 2:
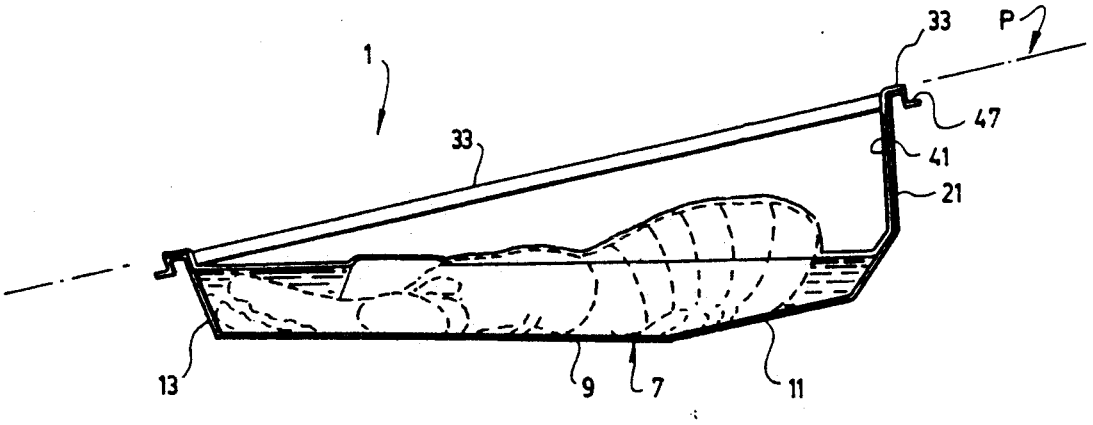
FIG. 2 is a cross-sectional view taken along line II—II of FIG. 1.
Figure 5:
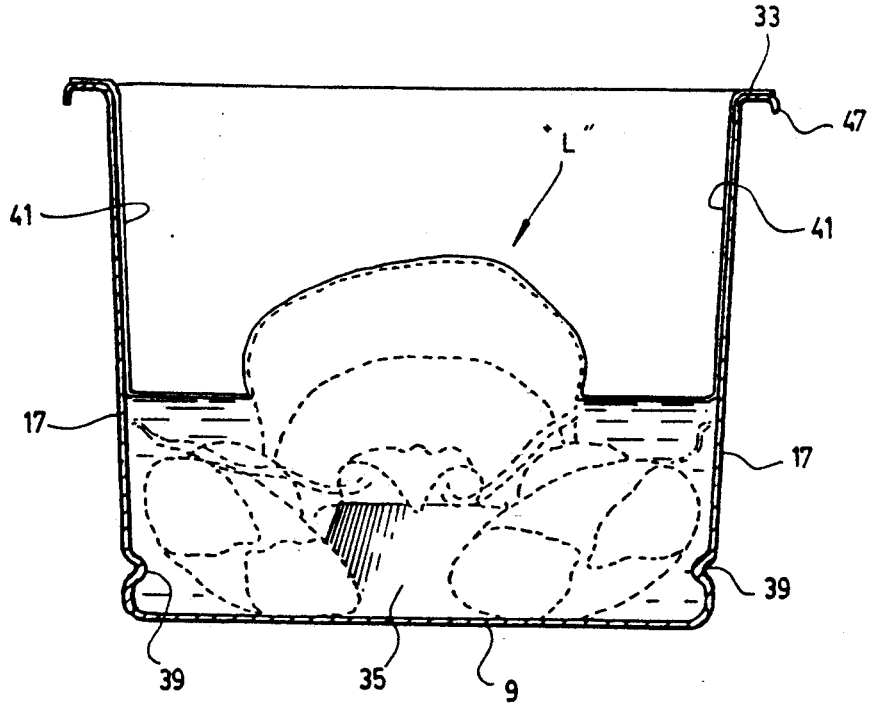
FIG. 5 is a cross-sectional view taken along line V—V of FIG. 4.

The lobster packaging and display unit 1 according to the invention as shown in FIGS. 1, 2 and 4 comprises two identical trays 3, 5 that are each shaped and sized to receive and conform to a lobster "L" and to display this lobster to best advantage. Each tray, say 5, comprises a bottom wall 7 having a front bottom wall portion 9 and a rear bottom wall portion 11. The tray 5 also comprises a front end wall 13, a pair of side walls 15 each having a front side wall portion 17 and a rear side wall portion 19 and a rear end wall 21.

The front end wall 13, the side walls 15 and the rear end wall 21 are all slightly tapering upwardly and outwardly from the bottom wall 7 to allow nesting of the unit 1 inside another unit having a similar number of trays or of one tray inside another one. Advantageously, each tray has its four upwardly projecting corner edges each shaped to define an outwardly projecting flat portion 23 at a same distance from the upper edges of the front end wall, side walls and rear end wall to prevent jamming of this tray when it is nested inside another similar tray.

As can be seen, the front bottom wall portion 9 is generally rectangular and the front bottom wall portion, the front side wall portions and the front end wall define a pair of front bottom corners 25 that are truncated.

As can also be seen, the rear bottom wall portion 11, the rear side wall portions 19 and the rear end wall 21 are configured and oriented relative to each other so as to form a niche 27 that is sufficiently narrow and deep to snugly receive and retain the tail of the lobster with this tail in folded position.

Figure 7:
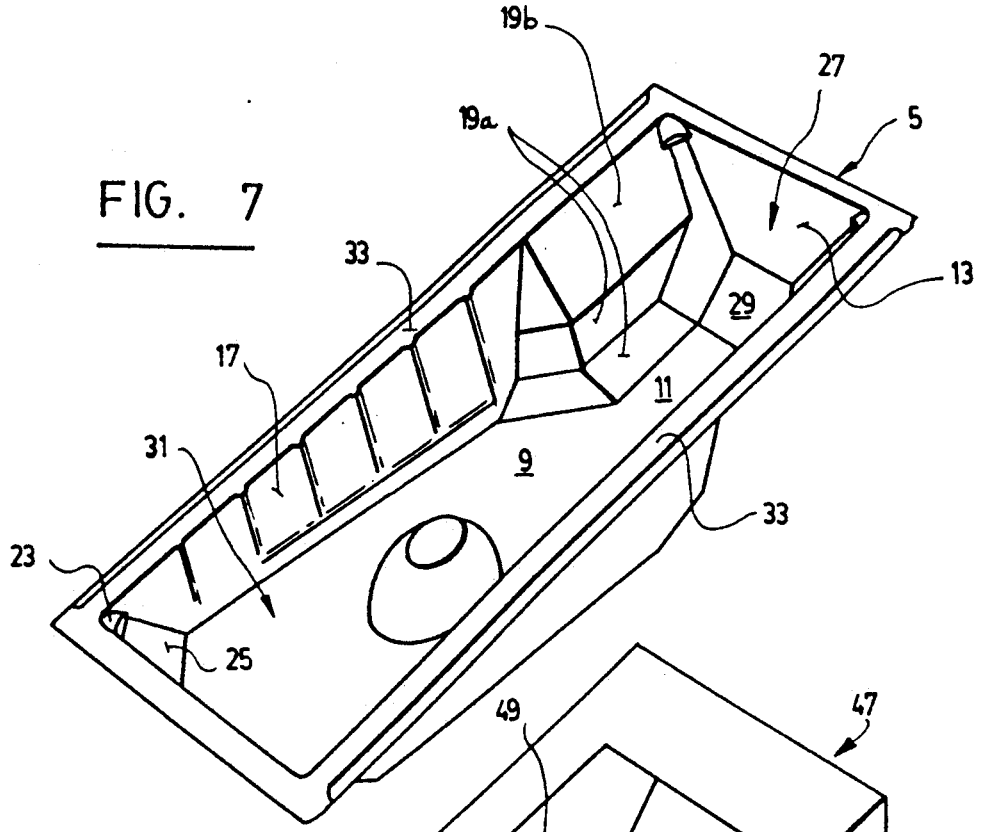
FIG. 7 is a perspective view of a further packaging and display unit according to the invention, including one tray only.

As better shown in FIG. 7, the niche 27 comprises a lower portion having a generally U-shaped cross-section, that is defined by the rear bottom wall portion 11 and lower parts 19*a* of the rear side wall portion. This lower portion of the niche has a height substantially identical to the height of the lobster's tail in folded position. It also comprises an upper portion with opposite walls 19*b* tapering upwardly outwardly. The rear bottom wall portion 9 and the rear end wall 13 define a short rear bottom edge that is truncated at 29.

The front bottom wall portion 9, the front side wall portions 17 and the front end wall 13 are configured and oriented relative to each other so as to form a space 31 (see FIG. 7) that is wide enough to receive the head and claws of the lobster with the claws extending fully forward within the space without substantially overlapping each other. This embodiment permits to individually expose the claws.

As can be seen, the front bottom wall portion 9 is generally flat and rectangular and the rear bottom wall portion 11 is angled upwardly rearwardly relative to the front bottom wall portion to raise and thus enhance the tail of the lobster with respect to its claws.

In accordance with an important aspect of the invention, the side walls, front end wall and rear end walls have upper edges 33 that extend perpendicularly to each other in a same plane "P" (see FIG. 2) to define a continuous rectangular opening on top of the tray, this opening being at least as long as the bottom wall 7 and at least as wide as the space 31. Advantageously, the upper edges 33 have a smooth surface and define a rectangular flange extending in the plane "P".

As is better shown in FIG. 2, the front end wall 13 has a height shorter than the height of the rear end wall 21 so that the plane "P" in which extend the upper edges 33 defining the rectangular opening, is inclined downwardly towards the front end wall relative to the bottom wall 7, and more particularly the front portion 9 thereof.

The front bottom wall portion 9 advantageously comprises a short upwardly projecting boss 35 preferably in the shape of a truncated cone, which is positioned centrally just in front of the head of the lobster between its claws, and whose utility will be described in greater detail hereinafter.

The packaging and display unit 1 is intended to be made of semi-rigid plastic material by molding, as is known per se. Due to its particular structure, including inter alia the flange 31, the unit is quite rigid. This ridigity may however be enhanced with reinforcing ribs 37 made in the front side wall portions 17, the ribs being equally spaced apart and extending perpendicularly to the upper edge or flange 31.

A locking rib 39 may also be molded in each of the front side wall portion 17, to project inside the tray close to, and parallel to the front bottom wall portion 9. The utility of this rib 39 is essentially to provide an anchoring means for the ice that is formed from a thin layer of water poured into the tray when the same is subsequently frozen. This in turn allows the lobster whose lower portion, legs and claws are "embedded" into the ice to be held flat on the bottom 7 of the tray and thus to be prevented from moving and breaking when the unit is handled or shipped.

As is clearly shown in the accompanying drawings, each tray is free of any sharp corner or edge. Its front end wall, its side walls, its rear end wall and its boss 35 have smooth surfaces as have its upper edges 33. This advantageously makes it possible to heat seal the tray with a thin transparent protective plastic film 41 without having this plastic film torn out by the lobster contained in the tray.

When the plastic film 41 is heat-sealed over the tray, it is substantially stretched prior to coming into contact with the top surface of the lobster and its claws that are full of sharp protuberances. The stretched film "sticks" to the lobster and to the walls of the tray and takes the shape of this lobster while covering the full cavity of the tray.

The smooth surfaces of the walls of the trays allow this shaping and prevents the film 41 from tearing. The boss 35 also helps in preventing the film from being stretched down too far between the head and claws of the lobster, which are the most "spiky" and would otherwise tear or pierce the film 1. Advantageously, the film 41 when used, seals the lobster from the environment in addition of helping in retaining it into the tray.

As is also clearly shown in FIGS. 1, 2 and 4, the drawings, the two trays 3 and 5 of the unit 1 are identical in shape and size. They are connected in adjacent and longitudinal parallel relationship through two of their longer upper edges adjacent each other. A weak zone 43 including a tearing line 45 may be provided between the adjacent upper edges or flanges to allow individual separation of the trays whenever desired.

When the unit is made by molding, the upper edges 33 may be formed as an outwardly projecting flange as was already explained hereinabove. This flange may itself be formed with a small downwardly projecting lip 47.

When the trays 3 and 5 are simultaneously molded the adjacent flanges and lips are extended outwardly as to produce the weak zone 43 joining the trays and the tearing line 47 is provided in the middle of this zone.

Figure 6:
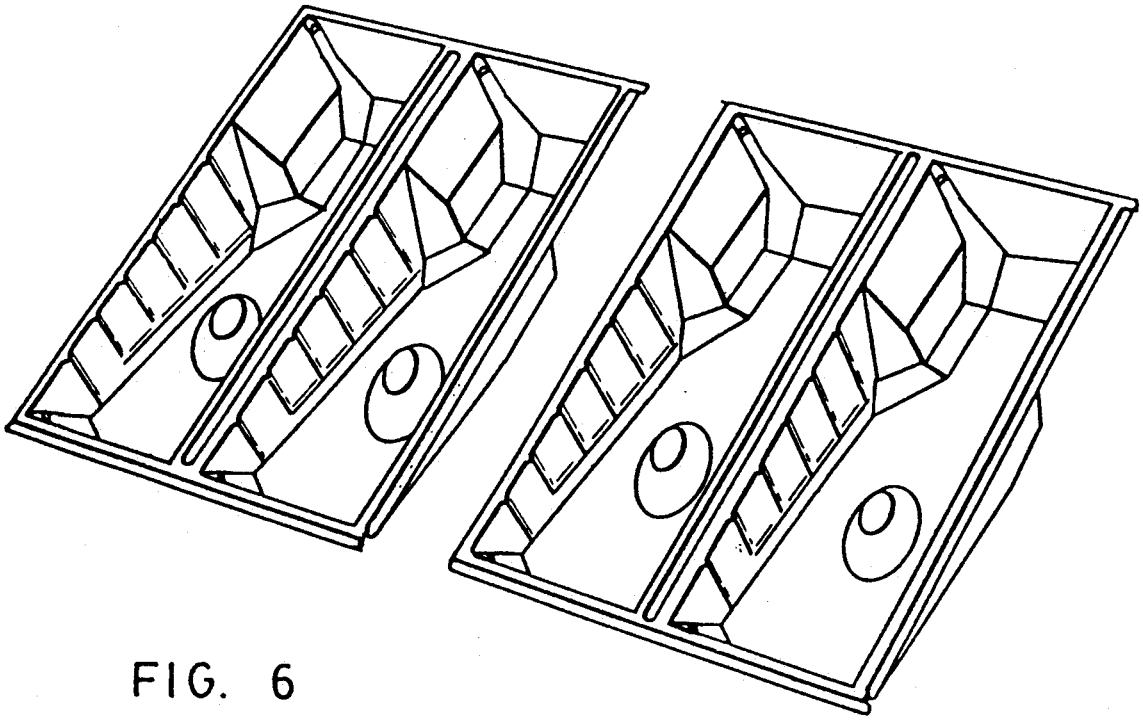
FIG. 6 is a perspective view of another packaging and display unit according to the invention, comprising four trays and more.

In the above embodiment, the unit 1 has been shown with two trays 3 and 5. It could however be made of one tray only, as shown in FIG. 8, or of more than two trays, as shown in FIG. 6.

In any event, each tray is designed to receive a lobster whether fresh or frozen, raw or uncooked, partly cooked or fully cooked. Thus, the lobster may be raw, frozen, fresh frozen or fresh.

In use, each tray contains a lobster and a small layer of water which is added to prevent the bottom of the lobster from unduly drying. When the water is frozen, it acts as retaining means to hold the lobster inside the tray thanks to the locking ribs 39. Then, the transparent protective film 41 may be heat-sealed onto the tray to close-fit the lobster and protects the same.

Figure 8:
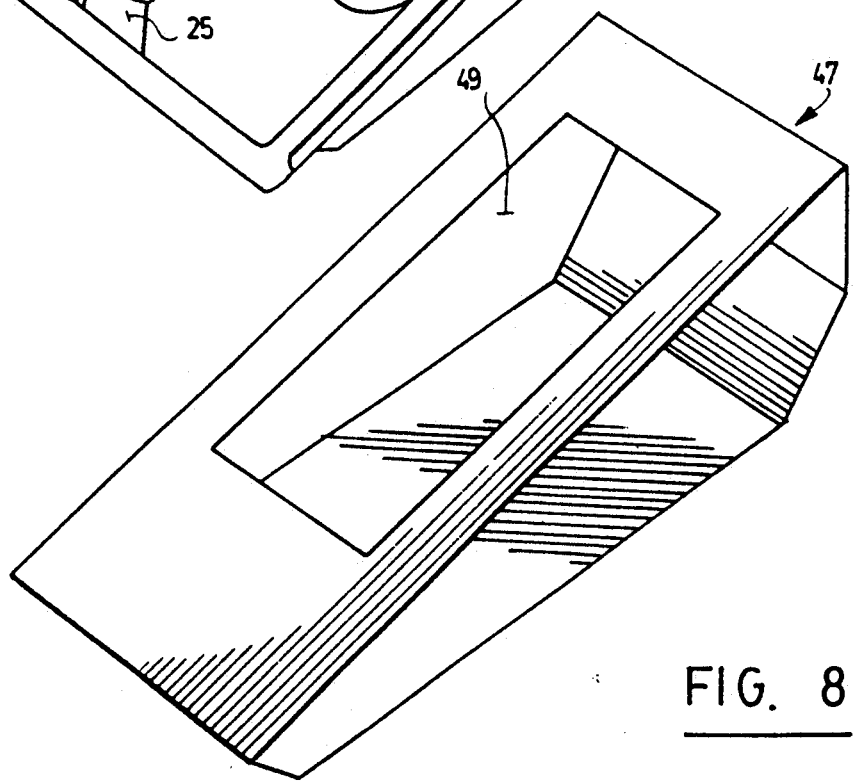
FIG. 8 is a perspective view of a sleeve shaped box sized to receive the unit shown in FIG. 7.

The unit 1 and/or each individual tray may be slid into a sleeve-shaped box 47 as shown in FIGS. 3 and 8, having a top surface provided with at least one large window 49 giving visual access to the lobster 7 contained in the tray(s) when the unit is slid in it.

The box 47 used with units having more than one tray may be provided with tearing line 51 (see FIG. 3) to tear it out into smaller boxes each sized to receive one tray whenever desired.

Samples of units were manufactured. Lobsters weighting in general between 200–300 grams, 300–500 grams and 500–800 grams respectively, were placed in the units as disclosed hereinabove. After addition of water, a plastic film was heat sealed and no tearing was observed. The film was prevented from overstretching thanks to the shape of the tray and, in particular, the boss which prevented it from moving too deeply into the unit. The film then offered an excellent skin patch.

As can be easily understood, the unit according to the invention is particularly interesting in that it exposes to sight the lobster that is protected by the film of plastic material. Thanks to its structure, the amount of water that must be used to prevent the lobster from drying is greatly reduced. The tray that extends preferably at an angle, emphasizes the display characteristics of the unit. Its rear end wall that is lifted, "enhances" the tail of the lobster in addition to reducing the amount of water necessary to protect the same. The rear portion of each tray which is narrower than the front portion increases the visual impact in addition to maintaining the tail well centered and again reducing the amount of water. The front portion of each tray allows full display of the claws. Last of all, the flanges and their lips help in obtaining good anchorage of the protection film while enabling easy separation of the unit in individual trays.

The present invention has been disclosed hereinabove with reference to some preferred embodiments. It is worth mentioning however that modifications could be made to these preferred embodiments within the scope of the appended claims, without changing or altering the nature and scope of the invention.

Figure 9:
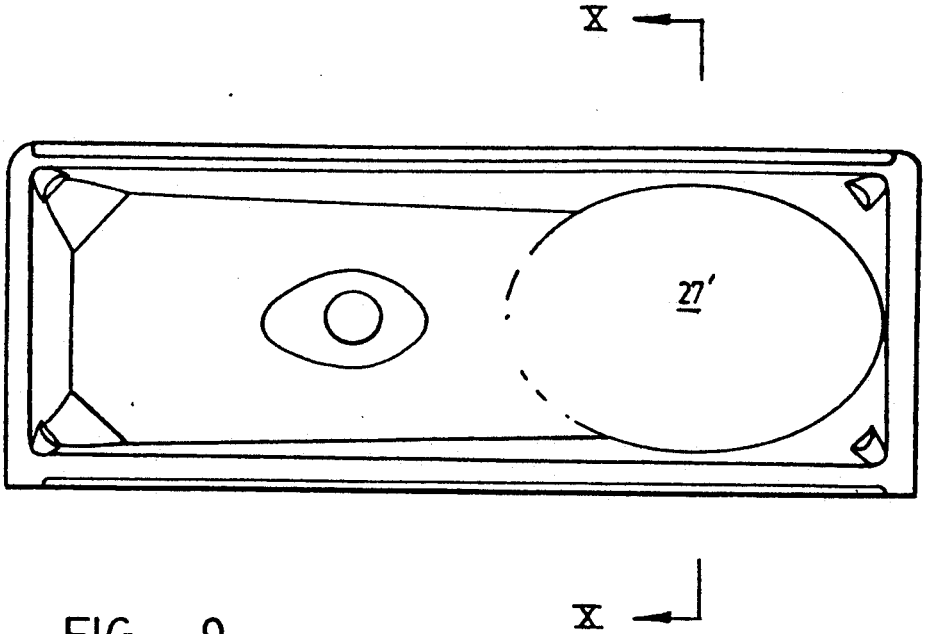
FIG. 9 is a top plan view of a further packaging and display unit comprising one tray with a concave rear portion.
Figure 10:
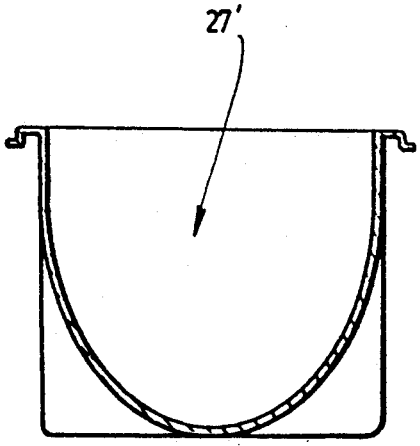
FIG. 10 is a cross-sectional view of the unit shown in FIG. 9, taken along line XI—XI.

Thus, by way of non-restrictive example, each tray could also be shaped as is shown in FIGS. 9 and 10, with the rear portion of the train forming an ovoid niche 27', with smooth incurved lateral walls and bottom.

I claim:

1. A lobster packaging and display unit comprising at least one tray shaped and sized to receive and conform to a lobster contained therein and to display the lobster to best advantage, wherein:

(a) said at least one tray comprises:
- a bottom wall having a front bottom wall portion and a rear bottom wall portion;
- a front end wall;
- a pair of side walls each having a front side wall portion and a rear side wall portion; and
- a rear end wall;

(b) the rear bottom wall portion, the rear side wall portions and the rear end wall are configured and oriented relative to each other so as to form a niche that is sufficiently narrow and deep to snugly receive and retain the tail of the lobster with said tail in folded position under itself;

(c) the front bottom wall portion, the front side wall portions and the front end wall are configured and oriented relative to each other so as to form a space wide enough to receive the head and claws of the lobster with said claws extending fully forward on said space without substantially overlapping each other;

(d) the side walls, front end wall and rear end walls have upper edges that extend perpendicularly to each other in a same plane to define a continuous rectangular opening on top of said at least one tray, said opening being at least as long as said bottom wall and at least as wide as said space;

(e) the front bottom wall portion comprises a short upwardly projecting boss positioned centrally just in front of the head of the lobster, between the claws, said boss being in the shape of a truncated cone; and (f) the front bottom wall portion is generally flat and the rear bottom wall portion is angled upwardly rearwardly relative to said front bottom wall portion to raise the tail of the lobster with respect to its claw.

2. The unit of claim 1, wherein the front end wall of said at least one tray has a height shorter than the height of the rear end wall so that the plane in which extend the upper edges defining the rectangular opening, is inclined downwardly towards the front end wall relative to the bottom wall.

3. The unit of claim 2, wherein:
- said at least one tray is free of any sharp corner or edge;
- the front end wall, the side walls, the rear end wall and the boss have smooth surface; and
- said upper edges also have smooth surfaces and define a rectangular flange extending in said plane,
- whereby it becomes possible to heat seal said at least one tray with a protective plastic film without having said plastic film being torn out by the lobster contained in said at least one tray.

4. The unit of claim 3, wherein:
- the front bottom wall portion is generally rectangular;
- the front bottom wall portion, the front side wall portions and the front end wall define a pair of front bottom corners that are truncated;
- the niche defined by the rear bottom wall portion, the rear side wall portions and the rear end wall comprises a lower portion having a generally U-shaped cross-section and a height substantially identical to the height of the lobster's tail in folded position, and an upper portion with opposite walls tapering upwardly outwardly;

the rear bottom wall portion and the rear end wall define a short rear bottom edge that is truncated; and the boss is substantially in the shape of a truncated cone.

5. The unit of claim 4, wherein the front side wall portions are provided with reinforcing ribs perpendicular to the upper edges of said front side wall portions.

6. The unit of claim 4, wherein each of said front side wall portions comprises at least one locking rib projecting inside said at least one tray close to, and parallel to the front bottom wall portion.

7. The unit of claim 4, wherein:

the front end wall, the side walls and the rear end wall are all slightly tapering upwardly and outwardly from the bottom wall to allow nesting of said at least one tray inside another identical tray; and said at least one tray has four upward corner edges each defining an outwardly projecting flat at a same distance from said upper edges to prevent jamming of said at least one tray when it is nested inside the other tray.

8. The unit of claim 4, comprising at least two of said trays, said trays being identical in shape and size and connected in adjacent and longitudinally parallel relationship through their adjacent upper edges.

9. The unit of claim 8, further comprising a weak zone between said adjacent upper edges to allow individual separation of the trays whenever desired.

10. The unit of claim 4, made of a molded plastic material.

11. The unit of claim 3, wherein each of said front side wall portions comprises at least one locking rib projecting inside said at least one tray close to, and parallel to the front bottom wall portion.

12. The unit of claim 3, wherein:

the front end wall, the side walls and the rear end wall are all slightly tapering upwardly and outwardly from the bottom wall to allow nesting of said at least one tray inside another identical tray; and said at least one tray has four upward corner edges each defining an outwardly projecting flat at a same distance from said upper edges to prevent jamming of said at least one tray when it is nested inside the other tray.

13. The unit of claim 3, made of a molded plastic material.

14. The unit of claim 1, wherein each of said front side wall portions comprises at least one locking rib projecting inside said at least one tray close to, and parallel to the front bottom wall portion.

15. The unit of claim 1, wherein:

the front end wall, the side walls and the rear end wall are all slightly tapering upwardly and outwardly from the bottom wall to allow nesting of said at least one tray inside another identical tray; and said at least one tray has four upward corner edges each defining an outwardly projecting flat at a same distance from said upper edges to prevent jamming of said at least one tray when it is nested inside the other tray.

16. The unit of claim 1, comprising at least two of said trays, said trays being identical in shape and size and connected in adjacent and longitudinally parallel relationship through their adjacent upper edges.

17. The unit of claim 16, further comprising a weak zone between said adjacent upper edges to allow individual separation of the trays whenever desired.

18. A lobster packaging and display unit made of molded plastic material and comprising at least one tray shaped and sized to receive and conform to a lobster contained therein and to display this lobster to best advantage, wherein:

(a) said at least one tray comprises:

a bottom wall having a front bottom wall portion and a rear bottom wall portion;

a front end wall;

a pair of side walls each having a front side wall portion and a rear side wall portion; and a rear end wall;

the front end wall, the side walls and the rear end wall slightly tapering upwardly and outwardly from the bottom wall to allow nesting of said at least one tray inside another identical tray;

the front bottom wall portion being generally rectangular and the front bottom wall portion, front side wall portions and front end wall defining together a pair of front bottom corners that are truncated;

(b) the rear bottom wall portion, the rear side wall portions and the rear end wall are configured and oriented relative to each other so as to form a niche that is sufficiently narrow and deep to snugly receive and retain the tail of the lobster with said tail in folded position under itself, said niche having a generally U-shaped cross-section and a height substantially identical to the height of the lobster's tail in folded position, and an upper portion with opposite walls tapering upwardly outwardly;

(c) the front bottom wall portion, the front side wall portions and the front end wall are configured and oriented relative to each other so as to form a space wide enough to receive the head and claws of the lobster with said claws extending fully forward on said space without substantially overlapping each other;

(d) the side walls front end wall and rear end walls have upper edges that extend perpendicularly to each other in a same plane to define a continuous rectangular opening on top of said at least one tray, said opening being at least as long as said bottom wall and at least as wide as said space;

(e) the front end wall of said at least one tray has a height shorter than the height of the rear end wall so that the plane in which extend the upper edges defining the rectangular opening, is inclined downwardly towards the front end wall relative to the bottom wall;

(f) the front bottom wall portion comprises a short upwardly projecting boss positioned centrally just in front of the head of the lobster, between the claws, said boss being in the shape of a truncated cone; and (g) the front bottom wall portion is generally flat and the rear bottom wall portion is angled upwardly rearwardly relative to said front bottom wall portion to raise the tail of the lobster with respect to its claws;

(h) each of said front side wall portions comprise at least one locking rib projecting inside said at least one tray close to, and parallel to the front bottom wall portion such that upon freezing a small layer of water in said tray, the lobster tail will be fixed to the locking rib via the ice that is formed, and (i) said at least one tray also has four upward corner edges each defining an outwardly projecting flat at a same distance from said upper edges to prevent jamming of said at least one tray when it is nested inside another tray.

19. The unit of claim 18, comprising at least two of said trays, said trays being identical in shape and size, and connected in adjacent and longitudinally parallel relationship through their adjacent upper edges.

20. The unit of claim 18, containing a lobster and a small layer of water inside each tray, said water being frozen and acting as a retaining means to hold the lobster inside the tray to the locking ribs, said unit also containing a transparent protective film heat sealed onto each tray to close-fit said lobster.

21. The unit of claim 20, further comprising a sleeve-shaped box in which said unit is laterally slid, said box having a top surface provided with at least one large window giving visual access to the lobster.

* * * * *